US008147658B2

(12) United States Patent
Amano et al.

(10) Patent No.: US 8,147,658 B2
(45) Date of Patent: Apr. 3, 2012

(54) SACRIFICIAL ELECTRODE MOUNTING STRUCTURE

(75) Inventors: Akira Amano, Wako (JP); Hiroshi Watanabe, Wako (JP); Wataru Shimazaki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 253 days.

(21) Appl. No.: 12/695,668

(22) Filed: Jan. 28, 2010

(65) Prior Publication Data

US 2010/0252424 A1 Oct. 7, 2010

(30) Foreign Application Priority Data

Apr. 6, 2009 (JP) ..... P2009-092330

(51) Int. Cl.
*C23F 13/18* (2006.01)

(52) U.S. Cl. ..... 204/196.31; 204/196.3; 204/196.17; 204/196.01; 204/196.37; 123/41.15

(58) Field of Classification Search ..... 440/80, 440/88 C, 88 M, 76, 78; 123/41.15, 41.01, 123/41.17, 41.28, 41.42, 41.31; 114/312, 114/337, 338; 204/196.31, 196.3, 196.17, 204/196.37, 196.01, 196.23, 196.24, 196.25
See application file for complete search history.

(56) References Cited

U.S. PATENT DOCUMENTS

| | | | | | |
|---|---|---|---|---|---|
| 4,545,332 | A | * | 10/1985 | Suzuki et al. | 123/41.01 |
| 4,588,385 | A | * | 5/1986 | Suzuki et al. | 440/88 R |
| 4,615,684 | A | * | 10/1986 | Kojima | 440/88 R |
| 4,872,860 | A | * | 10/1989 | Meisenburg | 440/113 |
| 5,716,248 | A | * | 2/1998 | Nakamura | 440/76 |
| 5,803,023 | A | * | 9/1998 | Takahashi et al. | 123/41.01 |
| 6,083,064 | A | * | 7/2000 | Watanabe et al. | 440/88 R |
| 6,109,987 | A | * | 8/2000 | Watanabe et al. | 440/88 R |
| 6,319,080 | B1 | * | 11/2001 | Watanabe et al. | 440/88 R |
| 7,121,907 | B2 | * | 10/2006 | Tateishi et al. | 440/88 R |
| 2010/0251978 | A1 | * | 10/2010 | Amano et al. | 123/41.01 |

FOREIGN PATENT DOCUMENTS

JP 2000-053086 A 2/2000

* cited by examiner

*Primary Examiner* — Bruce Bell
(74) *Attorney, Agent, or Firm* — Arent Fox LLP

(57) ABSTRACT

In a structure for mounting a sacrificial electrode in a cooling water passageway provided in a cylinder block of a water-cooled engine for an outboard engine unit, the cooling water passageway is defined by a groove portion provided in the cylinder block and a lid member closing an opening of the groove portion, a gasket member is provided between the groove portion and the lid member, and a screw fixedly fastens the sacrificial electrode to a bottom wall of the cooling water passageway. The gasket member has an extension portion opposed to a surface of the head of the screw located remote from the bottom wall of the cooling water passageway.

4 Claims, 4 Drawing Sheets

SACRIFICIAL ELECTRODE MOUNTING STRUCTURE

FIELD OF THE INVENTION

The present invention relates to an improvement in sacrificial electrode mounting structures.

BACKGROUND OF THE INVENTION

In outboard engine units, various metal portions are exposed to seawater, and thus, metal members more prone to corrosion than the metal portions are sometimes attached to the metal portions with a view to preventing corrosion of the metal portions. The "metal members more prone to corrosion" are called "sacrificial electrodes" or "sacrificial anodes" because they are more easily ionizable and have a lower positive potential than the metal portions and dissolve due to corrosion in place of the metal portions. Examples of the conventionally-known mounting structures for such a sacrificial electrode include one where the sacrificial electrode is mounted to face a water jacket (see, for example, Japanese Patent Application Laid-Open Publication No. 2000-53086).

According to the disclosure of the 2000-53086 publication, an anode mounting port is formed in the water jacket provided in a cylinder block, and an anode functioning as a sacrificial electrode is fixedly fastened, via a bolt, to the inner surface of a lid member closing the anode mounting port. As the anode dissolves, the bolt fixedly fastening the anode to the lid member gradually gets loosened and may fall off from the cylinder block.

In order to prevent the aforementioned inconvenience, a sacrificial electrode mounting structure shown in FIG. 6 has been proposed, in which a groove portion 102 is formed in a cylinder block 101 and a lid member 103 is mounted on the cylinder block 101 to close the opening of the groove portion 102, and in which a water jacket 104 functioning as a cooling water passageway is defined by the groove portion 102 and the lid member 103. Further, a sacrificial electrode 107 is fixedly fastened to a wall 106 of the groove portion 102 by means of a screw 108, and the lid member 103 has a protruding portion 103*a* formed on the inner surface thereof in opposed relation to a head portion 108*a* of the screw 108. By the provision of the protruding portion 103*a*, the screw 108 can be prevented from getting loosened to fall off from the cylinder block 107. However, the protruding portion 103*a* that protrudes into the water jacket 104 would undesirably narrow the cooling water passageway and hinder a flow of the cooling water within the water jacket 104.

SUMMARY OF THE INVENTION

In view of the foregoing prior art problems, it is an object of the present invention to provide an improved sacrificial electrode mounting structure which can reliably prevent falling-off of a threaded sacrificial-electrode mounting fastener member without adversely influencing a flow of cooling water within a water jacket.

In order to accomplish the above-mentioned object, the present invention provides an improved sacrificial electrode mounting structure for mounting a sacrificial electrode in a cooling water passageway provided in a cylinder block of a water-cooled engine for an outboard engine unit, which comprises: the cooling water passageway defined by a groove portion provided in the cylinder block and a lid member closing an opening of the groove portion; a gasket member provided between the groove portion and the lid member; and a threaded fastener member that fixedly fastens the sacrificial electrode to a bottom wall of the cooling water passageway, the gasket member having an extension portion opposed to a surface of a head of the fastener member located remote from the bottom wall of the cooling water passageway.

Thus, when the sacrificial electrode has dissolved considerably due to its corrosion and the faster member gets loosened, reducing or losing its axial force, the present invention can reliably prevent the faster member from falling off from the cylinder block because the head of the fastener member abuts against the gasket member. Preferably, the extension portion of the gasket member and the surface of the head of the fastener member are normally in contact each other or slightly spaced from each other with a gap therebetween. The threaded fastener member is passed through the sacrificial electrode and screwed into the bottom wall of the cooling water passageway. The lid member is an oil pump body or mount case of the engine.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

In the following description, the terms "front", "rear", "left" and "right" are used to refer to directions as viewed from a human operator aboard a boat.

Embodiment 1

Figure 1:
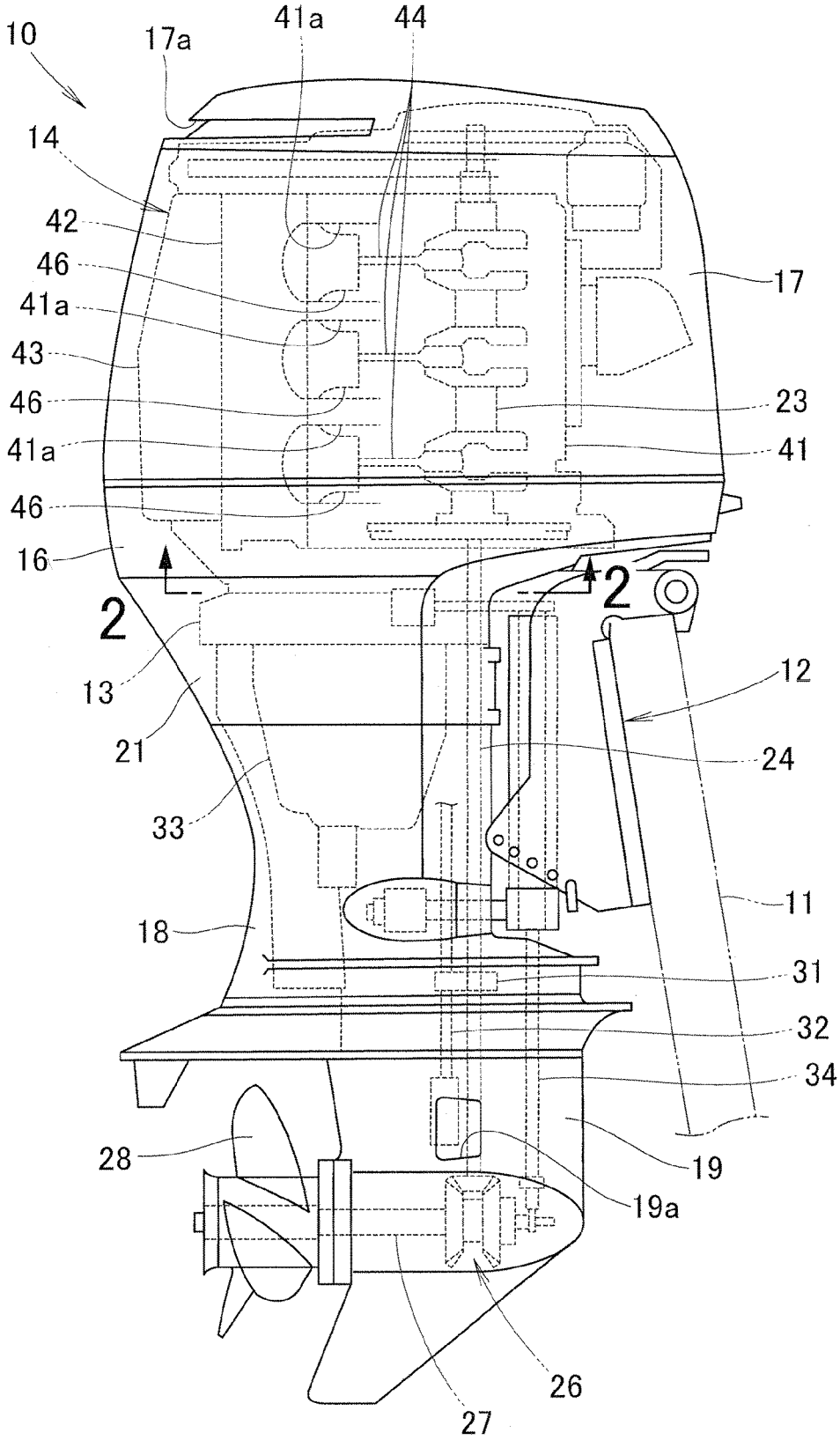
FIG. 1 is a side view of an outboard engine unit employing a first embodiment of a sacrificial electrode mounting structure of the present invention.

FIG. 1 is a side view of an outboard engine unit 10 employing a first embodiment of a sacrificial electrode mounting structure of the present invention. As shown, the outboard engine unit 10 includes: a mounting mechanism 12 mounted to a hull 11 of the boat; a mount case 13 mounted on an upper front portion of the mounting mechanism 12; a water-cooled V-type engine 14 mounted on an upper portion of the mount case 13; a lower engine case 16 mounted on the mount case 13 for covering a lower outer peripheral portion of the engine 14; and an upper engine cover 17 mounted on an upper end portion of the lower engine case 16 for covering an upper outer peripheral portion and upper end portion of the engine 14. The outboard engine unit 10 further includes: a gear case 19 mounted to a lower end portion of the mount case 13 via an extension case 18; an under cover 21 mounted to a lower end portion of the lower engine case 16 for covering an upper outer peripheral portion of the extension case 18; a drive shaft 24 connected to the lower end of a crankshaft 23 extending vertically in the engine 14; a propeller shaft 27 provided in the gear case 19 to extend in a front-rear direction of the outboard engine unit 10 and connected to the lower end of the drive shaft 24 via a gear mechanism 26; and a propeller 28 connected to a rear end portion of the propeller shaft 27.

The outboard engine unit 10 further includes: an air intake port 17*a* provided in an upper end portion of the upper engine cover 17 for taking air into an air intake device of the engine 14; a water intake port 19*a* formed in a side wall of the gear case 19 for taking seawater as cooling water into the engine 14; a water pump 31 provided on a halfway portion of the drive shaft 24; a cooling water supply pipe 32 for supplying the seawater, taken in by the water pump 31 through the water intake port 19*a*, to a water jacket within the engine 14; an oil pan 33 mounted to a lower end portion of the mount case 13; and a shift rod 34 connected to a shift lever for causing the boat to move forward or rearward or stop by switching between rotation and stoppage of the propeller 28.

Then engine 14 includes: a cylinder block 41 supporting the crankshaft 23; a cylinder head 42 mounted to the cylinder block 41; a head cover 43 closing an opening portion of the cylinder head 42; and pistons 46 connected via connecting rods 44 to the crankshaft 23 and movably inserted in respective cylinder holes 41*a* formed in the cylinder block 41. The water jacket 51 (FIG. 2) through which seawater circulates is provided in the cylinder block 41 and cylinder head 42, as will be detailed later.

Figure 2:
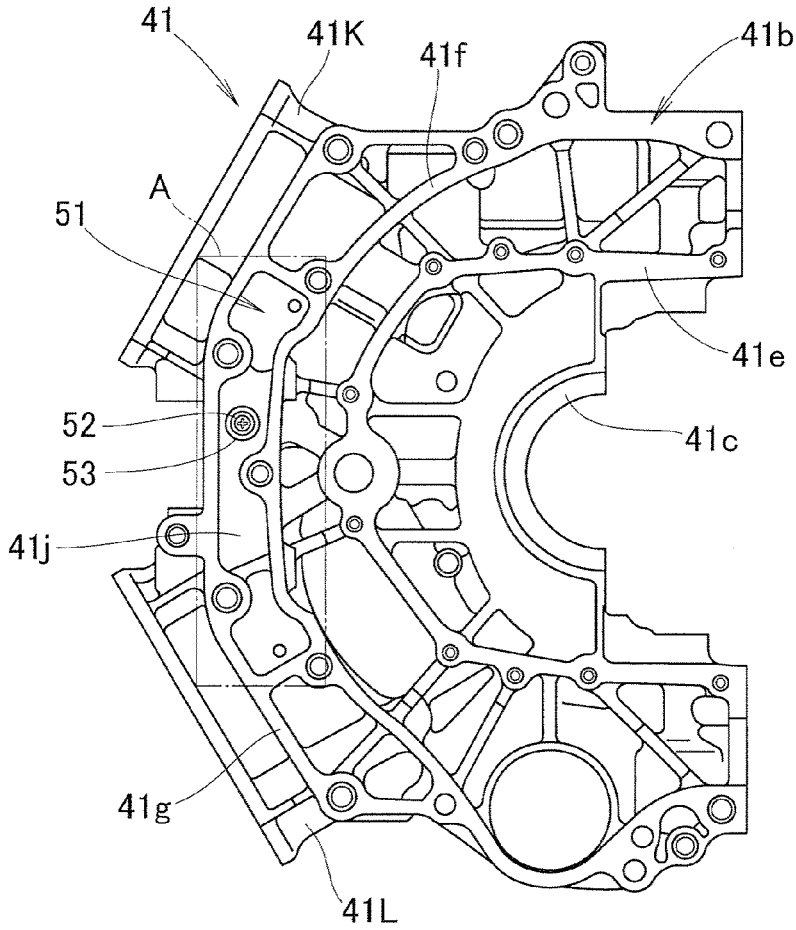
FIG. 2 is a sectional view taken along line 2-2 of FIG. 1.
Figure 3A:
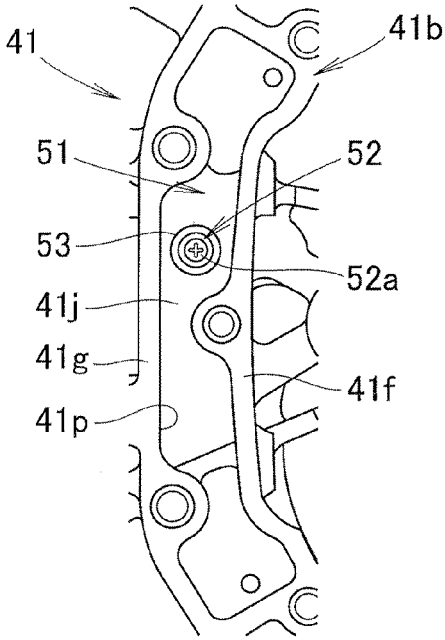
FIGS. 3A and 3B are enlarged views of a section depicted at A in FIG. 2.
Figure 3B:
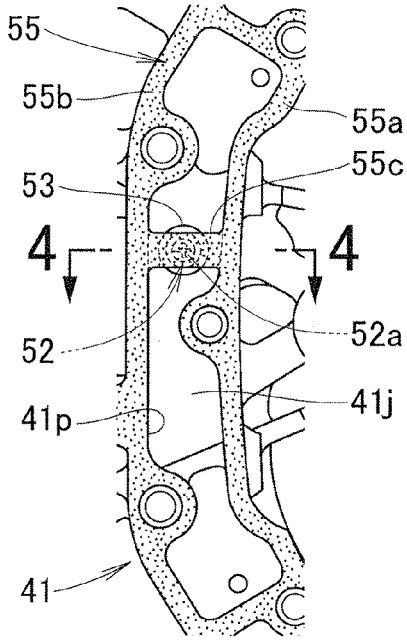

FIG. 2 is a sectional view taken along the 2-2 line of FIG. 1. A mounting surface 41*b* of the mount case 13 in the cylinder block 41 comprises an inner mounting surface 41*c*, a middle mounting surface 41*f* and an outer mounting surface 41*g*, each of which is formed in a C shape surrounding a main bearing section 41*c* that supports the crankshaft 23 (FIG. 1). Part of the water jacket 51 is defined between the middle mounting surface 41*f* and the outer mounting surface 41*g*, and an anode metal member 53 functioning as a sacrificial electrode is fixedly fastened to a bottom wall 41*j* of the water jacket 51 by means of a threaded fastener member (screw in the illustrated embodiment) 52. First and second cylinder sections 41K and 41L are formed in the cylinder block 41 in such a manner that the respective axis lines of the cylinder holes 41*a* (FIG. 1) are disposed in a "V" shape configuration FIGS. 3A and 3B are enlarged views of a section depicted at A in FIG. 2. As shown in FIG. 3A, a groove portion 41*p* defining the water jacket 41 is formed in the mounting surface 41*b* of the cylinder block 41, and the anode metal member 53 is disposed on the groove portion 41*b*. FIG. 3B shows a sealing gasket member 55 attached to the mounting surface 41*b*.

The gasket member 55 has inner and outer portions 55*a* and 55*b* formed in the same shapes as the middle mounting surface 41*f* and outer mounting surface 41*g*, respectively, of the cylinder block 41 and attached to the middle mounting surface 41*f* and outer mounting surface 41*g*, respectively, and a connecting portion (or extension portion) 55*c* integrally connecting the inner and outer portions 55*a* and 55*b*. The connecting portion 55*c* is opposed to and overlaps at least a surface of a head 52*a* of the screw 52 located remote from the bottom wall 41*j*, as viewed from below. Thus, the head 52*a* of the screw 52 is covered with the connecting portion 55*c*.

Figure 4:
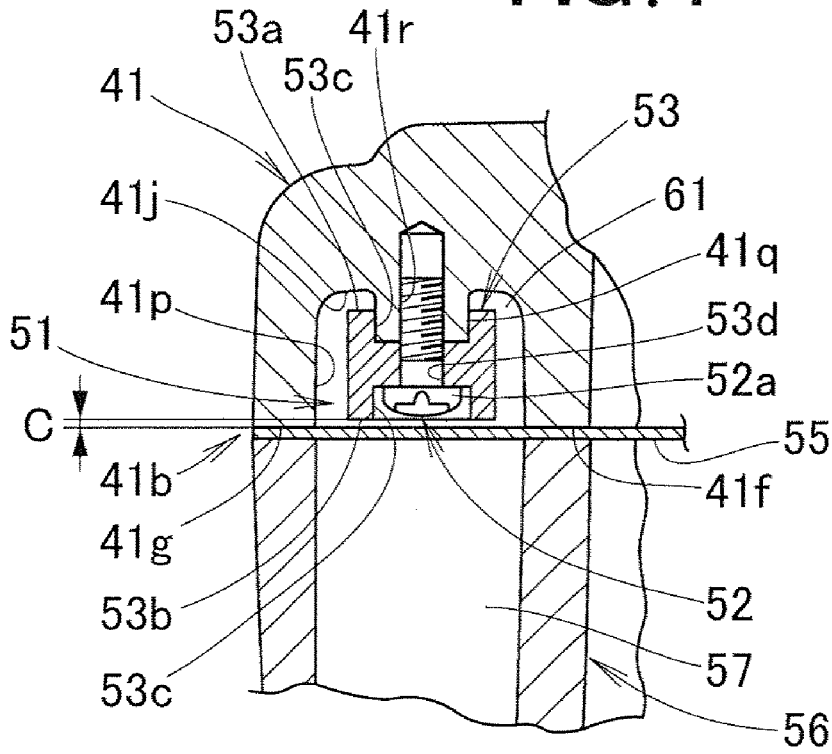
FIG. 4 is a sectional view taken along line 4-4 of FIG. 3B.

FIG. 4 is a sectional view taken along the 4-4 line of FIG. 3B. As shown, the groove portion 41*p* is formed in the mounting surface 41*b* of the cylinder block 41 between the middle mounting surface 41*f* and the outer mounting surface 41*g*. Further, a downwardly protruding portion 41*q* is formed on the bottom wall 41*j* of the groove portion 41*p* formed in the mounting surface 41*b* of the cylinder block 41, and an internal thread 41*r* is formed in the protruding portion 41*q*.

The anode metal member 53 is generally in the form of a circular column having opposite end surfaces 53*a* and 53*b*, and a recessed portion 53*c* is formed in each of the end surfaces 53*a* and 53*b*. Thus, the anode metal member 53 has a generally "H" sectional shape. A through-hole 53*d* is formed vertically through a central portion of the anode metal member 53 located between the recessed portions 53*c*. One of the recessed portions 53*c* is fitted over the protruding portion 41*q* of the cylinder block 41, and the screw (threaded fastener member) 52 is passed through the through-hole 53*d* formed in the anode metal member 53. The anode metal member 53 is fixedly fastened to the bottom wall 41 of the groove portion 41*p* with a distal end portion of the screw 52 screwed to the internal thread 41*r*. When the anode metal member 53 is duly fixed to the bottom wall 41, the head 52*a* of the screw 52 is located closer to the bottom wall 41*j* than the middle mounting surface 41*f* and the outer mounting surface 41*g*.

As further shown in FIG. 4, an oil pump body 56 of the engine is attached to the middle mounting surface 41*f* and outer mounting surface 41*g* with the gasket member 55 sandwiched therebetween. The oil pump body 56 forms an oil pump case, and the gasket member 55 seals between the cylinder block 41 and the oil pump body 56. Reference numeral 57 indicates an in-oil-pump cooling water passageway.

The groove portion 41*p* of the cylinder block 41 and the gasket member 55 constitute a cooling water passageway 61 that is part of the water jacket 51, and the cooling water passageway 61 is in communication with the above-mentioned in-oil-pump cooling water passageway 57.

The connecting portion 55*c* of the gasket member 55 and the head 52*a* of the screw 52 are normally in contact each other or slightly spaced from each other with a gap C therebetween. Thus, when the anode metal member 53 has dissolved considerably, due to its corrosion, so that the screw 52 gets loosened, reducing or losing its axial force, the instant embodiment can reliably prevent the screw 52 from falling off from the cylinder block 41 because the head 52*a* of the screw 52 abuts against the gasket member 55.

Figure 6:
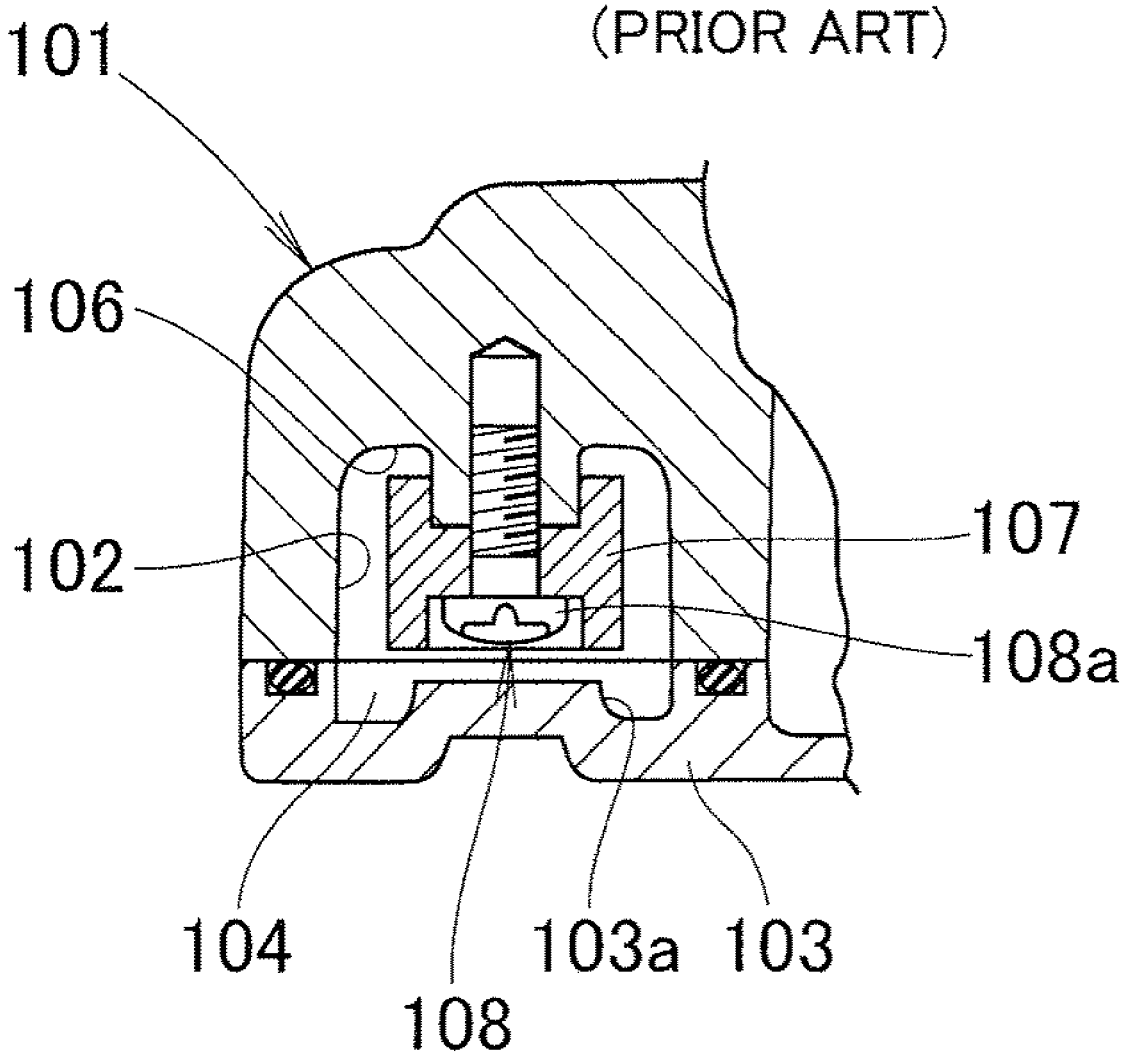
FIG.6 (PRIOR ART)
FIG. 6 is a sectional view of a conventionally-known sacrificial electrode mounting structure.

Further, the instant embodiment can eliminate a need for provision of a heretofore-required protruding portion (like the one 103*a* in the conventionally-known sacrificial electrode mounting structure of FIG. 6) that is located in opposed relation to the head 52*a* of the screw 52 and protrudes into the cooling water passageway 61, where the anode metal member 53 is disposed, for preventing falling-off of the screw 52. Hence, the instant embodiment does not narrow the cooling water passageway 61 to hinder a flow of the cooling water and can avoid a cost increase due to formation of such a protruding portion.

Embodiment 2

Figure 5:
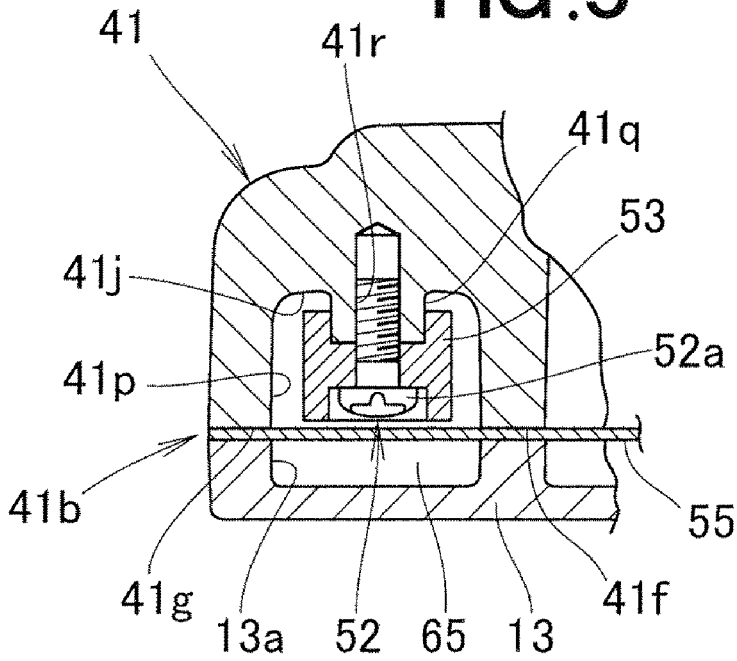
FIG. 5 is a sectional view showing a second embodiment of the sacrificial electrode mounting structure of the present invention.

FIG. 5 is a sectional view showing a second embodiment of the sacrificial electrode mounting structure of the present invention which is applied to a portion of the cylinder block 41 positionally corresponding to the mount case 13. Elements similar in construction and function to those in the first embodiment are indicated by the same reference numerals as used for the first embodiment and will not be described here to avoid unnecessary duplication.

As shown in FIG. 5, the mount case 13 is mounted to the lower end mounting surface 41*b* of the cylinder block 41 with the gasket member 55 sandwiched therebetween. A mount case groove portion 13*a* is formed in the inner surface of the mount case 13, and this mount case groove portion 13*a* and the gasket member 22 constitute a mount case cooling water passageway 65 that is part of the water jacket 51. The mount case cooling water passageway 65 is in communication with the above-mentioned cooling water passageway 61. This embodiment too can reliably prevent the screw 52 from falling off from the cylinder block 41 because the head 52*a* of the screw 52 abuts against the gasket member 55.

Namely, according to the present invention, as shown in FIGS. 1, 2 and 4, the sacrificial electrode mounting structure is designed for mounting the anode metal member 53, functioning as a sacrificial electrode, in the water jacket 51 that is a cooling water passageway provided in the cylinder head 42 or cylinder block 41 of the water-cooled engine 14 of the outboard engine unit 10. The water jacket 51 comprises the groove portion 41*p* provided in the cylinder head 42 or cylinder block 41, and the oil pump body 56 (or mount case 13) functioning as a lid member that closes the opening of the groove portion 41*p*. The gasket member 55 is provided between the groove portion 41*p* and the lid member, and the anode metal member 53 is fixedly fastened, by means of a threaded fastener member (screw) 52, to the bottom wall 41*j* of the water jacket 51. The head 52*a* of the screw 52 is covered with the connecting portion (extension portion) 55*c* of the gasket member 55, and thus, when the anode metal member 52 has dissolved, the gasket member 55 can prevent the screw 52 from getting loosened to fall off from the cylinder block 41.

The sacrificial electrode mounting structure of the present invention is well suited for application to outboard engine units.

What is claimed is:

1. A sacrificial electrode mounting structure for mounting a sacrificial electrode in a cooling water passageway provided in a cylinder block of a water-cooled engine for an outboard engine unit, the sacrificial electrode mounting structure comprising:

the cooling water passageway defined by a groove portion provided in the cylinder block and a lid member closing an opening of the groove portion;

a gasket member provided between the groove portion and the lid member; and a threaded fastener member that fixedly fastens the sacrificial electrode to a bottom wall of the cooling water passageway, the gasket member having an extension portion opposed to a surface of a head of the fastener member located remote from the bottom wall of the cooling water passageway, so that the fastener member can be prevented, by the extension member, from falling off from the cylinder block.

2. The sacrificial electrode mounting structure of claim 1, wherein the extension portion of the gasket member and the surface of the head of the fastener member are normally in contact each other or slightly spaced from each other with a gap therebetween.

3. The sacrificial electrode mounting structure of claim 1, wherein the lid member is an oil pump body of the engine.

4. The sacrificial electrode mounting structure of claim 1, wherein the lid member is a mount case of the engine.

* * * * *